US005380425A

United States Patent [19]

Child et al.

[11] Patent Number: 5,380,425

[45] Date of Patent: Jan. 10, 1995

[54] OVER ALKYLATION AND CATALYTIC CRACKING FOR BENZENE CONVERSION

[75] Inventors: Jonathan E. Child, Sewell, N.J.; James K. Wolfenbarger, Torrance, Calif.

[73] Assignee: Mobil Oil Corporation, Fairfax, Va.

[21] Appl. No.: 114,581

[22] Filed: Aug. 31, 1993

[51] Int. Cl.[6] ..... C10G 57/00; C10G 61/02; C10G 63/04; C07C 2/68

[52] U.S. Cl. ..... 208/62; 208/79; 208/138; 585/316; 585/446; 585/467; 585/471

[58] Field of Search ..... 208/62, 65, 64, 79, 208/80, 135, 138, 141; 585/446, 448, 467, 471, 475, 316

[56] References Cited

U.S. PATENT DOCUMENTS

| | | | |
|---|---|---|---|
| 3,969,426 | 7/1976 | Owen et al. | 260/668 R |
| 4,140,622 | 2/1979 | Herout et al. | 208/93 |
| 4,393,262 | 7/1983 | Kaeding | 585/467 |
| 4,454,364 | 6/1984 | Farcasiu et al. | 585/470 |
| 4,577,049 | 3/1986 | Rudnick | 585/486 |
| 4,827,069 | 5/1989 | Kushnerick | 585/415 |
| 4,997,543 | 3/1991 | Harandi et al. | 208/79 |
| 5,082,983 | 1/1992 | Breckenridge et al. | 585/475 |

*Primary Examiner*—Asok Pal
*Assistant Examiner*—Bekir L. Yildirim
*Attorney, Agent, or Firm*—Alexander J. McKillop; Malcolm D. Keen; Richard D. Stone

[57] ABSTRACT

A process for producing a low benzene content gasoline is disclosed. Catalytic reforming produces a benzene rich reformate which is fractionated to yield a benzene rich C6 fraction which is then over-alkylated, preferably with C2/C3 olefins from an FCC, to produce heavy alkylate having too high an end point for use as gasoline. Heavy alkylate is charged to an FCC reactor, along with a conventional heavy FCC feed, and converted back into a gasoline boiling range product. Heavy alkylate also produces reactive alkyl fragments in the cracking reactor which react with benzene produced during cracking of FCC heavy feed.

15 Claims, 1 Drawing Sheet

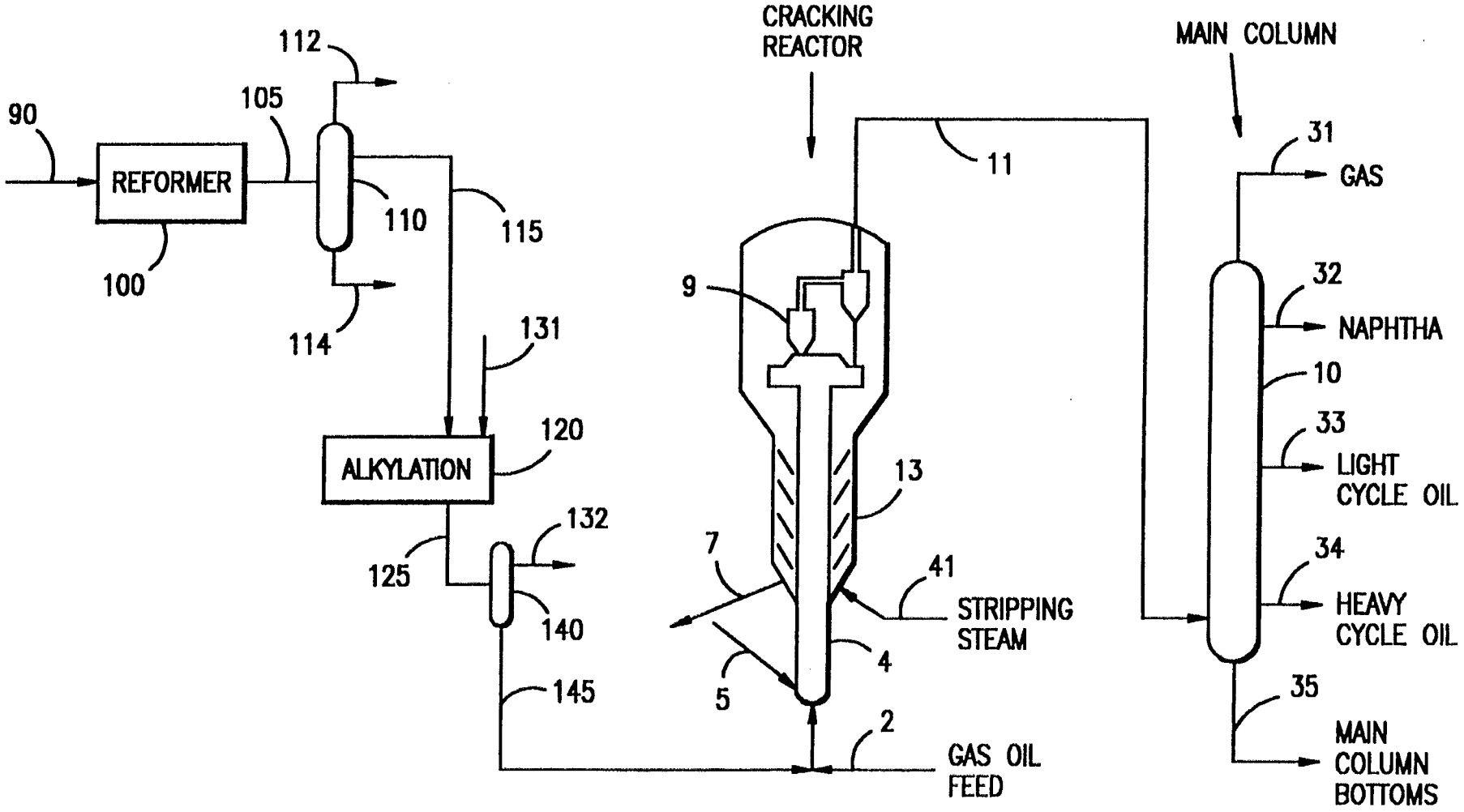
MAIN COLUMN
31
GAS
32
NAPHTHA
10
33
LIGHT CYCLE OIL
34
HEAVY CYCLE OIL
35
MAIN COLUMN BOTTOMS
CRACKING REACTOR
11
9
13
41
STRIPPING STEAM
4
2
GAS OIL FEED
7
5
90
REFORMER
100
105
112
110
114
115
131
120
ALKYLATION
125
132
140
145

OVER ALKYLATION AND CATALYTIC CRACKING FOR BENZENE CONVERSION

FIELD OF THE INVENTION

This invention relates to fluid catalytic cracking, aromatics alkylation and catalytic reforming.

DESCRIPTION OF RELATED ART

The invention overcomes a problem in a mature process, catalytic reforming, by making unconventional use of two other mature process, aromatics alkylation and catalytic cracking. The problem is excessive benzene content in reformate. Reforming will be reviewed first.

Catalytic reforming of naphtha boiling range feed over Pt catalyst to produce high octane reformate is one of the most successful processes in the world. More than a hundred units are in use, converting low octane naphthas to high octane, aromatic rich gasoline. The product inherently contains large amounts of aromatics, including benzene. Many localities now limit the amount of benzene which can be in gasoline, because of toxicity.

Usually refiners have looked on catalytic reformers as aromatics generators, and welcomed, rather than avoided, the production of aromatic hydrocarbons. Many refineries recover benzene rich streams, usually by L/L extraction with a solvent such as Sulfolane, and then alkylate the purified streams with light olefins. Such processing, to produce ethylbenzene or xylenes, usually requires highly purified benzene. This approach inherently tends to produce a by-product gasoline with a lower benzene content, but can only be justified when there is demand for a high value product and capital available to build expensive solvent purification facilities. Such an approach also reduces the volume of gasoline produced. There is a need for a simpler approach, which makes better use of existing refinery facilities, which requires only fractionation to isolate a benzene rich fraction and which does not reduce gasoline production.

Refiners have removed benzene from light reformate in various ways.

In U.S. Pat. No. 4,140,622, Herout et al, incorporated by reference, a reformate was fractionated to make a benzene rich fraction which was mixed with C3/C4 olefins and passed over an alkylation catalyst such as SPA, or solid phosphoric acid. This produces an alkylate which still contains some benzene.

In U.S. Pat. No. 4,209,383, Herout et al, incorporated by reference, a reformate and C3-C4 olefins from an FCC were combined, passed through a dehexanizer, then passed through an alkylation zone.

In U.S. Pat. No. 5,082,983 incorporated by reference, a benzene rich fraction from a reformer was charged to an FCC unit, where some of the benzene would be converted.

In U.S. Pat. No. 5,053,573 incorporated by reference, a benzene rich fraction from a reformer was alkylated or transalkylated with cycle oils from an FCC unit.

While all of these approaches, especially the last two, were helpful at reducing the benzene content of the gasoline pool, they still had limitations.

Approaches involving alkylation or transalkylation in a an FCC reactor were efficient and low cost, but never got as much of the benzene as was desired.

The use of a separate alkylation reactor, as disclosed in '573, permitted higher conversions of benzene because reaction conditions could be optimized for benzene alkylation, but the constraint was formation of heavy "alkylate". Alkylated benzene is even more reactive than benzene, and refiners terminate the alkylation reaction too soon, to avoid formation of material heavier than gasoline. This avoided making gasoline with a high boiling distillation "tail", but also limited the amount of benzene conversion that could be achieved per pass through the alkylation reactor.

We wanted to continue to use catalytic reforming, and perhaps even push it a little harder so that it would produce even higher octane reformate, even if that meant production of more benzene. We realized that this could be done, if unusual use were made of two other mature technologies, cat cracking and aromatics alkylation, each of which will now be briefly reviewed.

Fluidized catalytic cracking (FCC) of hydrocarbons has enjoyed worldwide success. It is the method of choice for converting a heavy feed into lighter, more valuable products, the most valuable of which are usually the high octane gasoline and the light olefins. The FCC naphtha invariable contains some benzene, but always much less benzene than a comparable boiling range reformate. Typical FCC naphthas have 3 or 4 wt % benzene in the C5 to 385 F fraction. Until recently, this was not a troublesome amount of benzene, but some jurisdictions now impose limits on benzene concentrations in gasoline. Benzene contents of less than 1.0 wt %, and in some instances even less than 0.5 or 0.1 wt % benzene are becoming standard for gasoline.

Catalytic cracking occurs in the absence of externally added H2 in contrast to hydrocracking in which H2 is added. An inventory of catalyst cycles between a cracking reactor and a catalyst regenerator. In fluidized catalytic cracking (FCC), hydrocarbon feed contacts 60–80 micron catalyst in a reactor at 425C–600C, usually 460C–560C. The hydrocarbons crack, and deposit coke on the catalyst. Cracked products are separated from the coked catalyst, which is stripped of volatiles, usually with steam, and then regenerated. In the catalyst regenerator, coke is burned, restoring catalyst activity and heating the catalyst to 500C–900C, usually 600C–750C.

Modern FCC regenerators operate at fairly high temperatures, to minimize CO emissions and as a reflection of the heavier feeds now being processed in FCC units. Most FCC units are in "heat balanced" operation, with the heat energy needed to crack fresh feed being supplied by burning coke deposited on the catalyst during the cracking reaction.

Cracked products are fractionated into light, olefin rich gas, gasoline, light and heavy cycle oils, and slurry oils. The olefinic light gasses are usually alkylated with isobutane in the presence of sulfuric or HF acid, producing alkylate which is essentially free of aromatics. The cycle oils are sold as fuel. Many units recycle modest amounts of heavy material, heavy cycle oil or slurry oil, the heaviest product to the FCC. These materials, especially slurry oil, are difficult to crack further, and much of the recycled material is converted to coke in the FCC, and some lighter product.

Most older FCC units regenerate the spent catalyst in a single dense phase fluidized bed of catalyst. Although there are myriad individual variations, typical designs are shown in U.S. Pat. No. 3,849,291 (Owen) and U.S. Pat. No. 3,894,934 (Owen et al), and U.S. Pat. No. 4,368,114 (Chester et at.) which are incorporated by reference. Many newer units use high efficiency designs, with a fast fluidized bed coke combustor, dilute phase transport riser, and second dense bed to collect regenerated catalyst.

A further description of the catalytic cracking process may be found in the monograph, "Fluid Catalytic Cracking With Zeolite Catalysts" Venuto and Habib, Marcel Dekker, New York, 1978, incorporated by reference.

Some efforts have been made to reduce the benzene content of the FCC gasoline. U.S. Pat. No. 5,082,983, Breckenridge et al, discloses adding a light reformate fraction to an FCC unit, along with an alkylating agent such as durene. The benzene is alkylated in the FCC reactor. Table 3 shows the equilibrium distribution from a 50/50 mixture of durene and benzene. Over 90% conversion of benzene to other alkyl components, and conversion of over 95% of the durene to other alkyl components is predicted.

Aromatics alkylation is a mature technology. Aromatics can be alkylated using an acid acting catalyst. HF alkylation is a popular way to make linear alkylbenzenes (LAB) for detergent manufacture. Various solid bed alkylation processes have been proposed using zeolite or amorphous catalysts. The processes all face limits set by reaction kinetics. Complete conversion leads to over alkylation, and production of excessive amounts of poly-alkylated benzene species which can not be used in the refinery gasoline pool. Limiting conversion prevents over alkylation, but leaves benzene unconverted.

To summarize, there is no way to remove efficiently the remaining amounts of benzene in the refinery gasoline pool with known technology. There is no way to operate a reformer without producing benzene. Reformers should if anything be pushed harder to make even higher octane gasoline even if this means more benzene production. Any benzene removal steps must be performed downstream of the reformer.

Aromatics extraction can be used to remove benzene, but the process is expensive, never gets all the benzene, and shrinks the gasoline pool. Although there is enough benzene-toluene and xylene (BTX) in reformate to justify aromatics extraction to generate petrochemical feed stocks, there is not enough benzene to justify the cost of a liquid/liquid extraction unit merely to get benzene out of the gasoline pool. FCC gasoline has even less benzene so it is even harder to justify aromatics extraction for FCC gasoline.

Recovery of a benzene rich fraction essentially by fractionating reformate, i.e., without any solvent extraction or other aromatics extraction process, is a low cost way to remove benzene. It loses a large volume of the reformate product, however. If this benzene fraction is then charged to an FCC unit, much of the gasoline pool will be recovered, but the FCC processing will not remove the last traces of benzene, because so many reactions are going on in the cracking reactor.

We discovered a way to take a light reformate stream, and process it so that well over 90% of the benzene could be converted. We opted for over alkylation of the benzene, to deliberately produce a mix of alkylated aromatics which could be added directly to the gasoline blending pool and heavy ends which could not. We then used the cat cracker as an efficient and inexpensive way to reduce the boiling range sufficiently so that C7 and heavier aromatics were produced which would end up with the FCC naphtha. We also regenerated, from the heavy alkylate, light olefins. These could be used in the riser to alkylate benzene or downstream of the FCC unit, in aromatics alkylation or for alkylation of isobutane in an HF or sulfuric acid alkylation unit). Our overalkylated reformate provides a safer way to add reactive fragments to an FCC riser than addition of durene, which has a high freeze point and many refiners are afraid to adopt a process which might, during a process upset, add durene to the refinery gasoline pool.

BRIEF SUMMARY OF THE INVENTION

Accordingly, the present invention provides a process for producing a gasoline product with a reduced benzene content comprising producing a benzene rich gasoline product fraction by reforming a naphtha boiling range feed comprising normally liquid hydrocarbons boiling below about 400 F. in a reforming reactor containing a platinum based reforming catalyst at catalytic reforming conditions to produce reformate consisting of gasoline and lighter hydrocarbons; fractionating said reformate to produce a C6 fraction containing benzene; overalkylating said C6 reformate fraction by charging said C6 fraction to an aromatics alkylation zone and alkylating with an alkylating agent comprising at least one of C2, C3 and C4 olefins operating at aromatics alkylation conditions sufficient to alkylate over 90% of the benzene and produce heavy alkylate, a polyalkylated benzene product boiling above about 400 F. and too high for use as a gasoline fuel; catalytically cracking, in the absence of added hydrogen, a conventional FCC feed comprising normally liquid hydrocarbons boiling above about 650° F. and said heavy alkylate in a catalytic cracking reactor operating at catalytic cracking conditions to produce a spectrum of catalytically cracked products from said conventional FCC feed and crack a majority of the heavy alkylate product boiling above 400 F. to alkylated benzene species boiling below 400 F. and in the gasoline boiling range and removing from said cracking reactor a vapor stream of cracked products with cracked heavy alkylate; fractionating this vapor in an FCC cracked product fractionator operating at fractionation conditions to produce a catalytically cracked naphtha fraction comprising normally liquid hydrocarbons boiling below about 400 F. including at least a majority of the polyalkylated benzene added to the cracking reactor.

In another embodiment, the present invention provides a fluidized catalytic cracking (FCC) process for the production of a gasoline boiling range product containing less than 1.0 wt % benzene from a heavy hydrocarbon FCC feed containing hydrocarbons boiling above about 650 F. comprising adding to said heavy FCC feed 1 to 50 wt % of a light reformate alkylate (LRA) produced by alkylating a C6 reformate fraction with sufficient C2, C3 and/or C4 olefins to produce an alkyl aromatic product having 12 or more carbon atoms and essentially free of durene; catalytically cracking said FCC feed and said LRA in a catalytic cracking zone operating at catalytic cracking conditions by contacting said feed with a source of hot regenerated cracking catalyst to convert at least 60 wt % of the FCC feed to lighter products and produce a cracking zone effluent mixture comprising cracked products and spent cracking catalyst containing coke and strippable hydrocarbons; separating said cracking zone effluent mixture into a cracked product vapor phase and a spent catalyst rich phase; stripping and regenerating spent catalyst to produce regenerated catalyst which is recycled to said cracking reactor; and transferring from said cracking reactor said cracked product vapor phase via a transfer line connective with a main fractionator which recovers liquid product fractions including a gasoline boiling range fraction having less than 1.0 wt % benzene.

BRIEF DESCRIPTION OF THE DRAWINGS

The FIGURE is a simplified, cross-sectional view of an embodiment of the invention, with a reformer, aromatics alyklation unit, and a cracking reactor and fractionator.

DETAILED DESCRIPTION

The invention can be better understood with reference to the FIGURE. Most of the items discussed can be conventional, i.e., a conventional FCC unit, conventional aromatics alkylation unit, and conventional reformer can be used. These pieces of equipment are operated unconventionally, and integrated together in an unconventional way, to efficiently produce gasoline with an extraordinarily low benzene content. The drawing review starts with the FCC unit, and then addresses the reformer and aromatics alkylation units. Most details of the cracking reactor are based on FIG. 1 of U.S. Pat. No. 5,082,983, which was incorporated by reference. The regenerator of the FCC is omitted to permit showing on a single sheet the reformer and alkylation unit with the FCC.

A heavy feed, typically a gas oil boiling range material, is charged via line 2 to mix with a light alkylate stream in line 135, and the mixture is charged to the lower end of a riser cracking FCC reactor 4. Hot regenerated catalyst is added via conduit 5 to the riser, from a regenerator not shown. Preferably, some atomizing steam is added, by means not shown, to the base of the riser, usually with the feed. With heavier feeds, e.g., a resid, 2–10 wt. % steam may be used. The alkylate, heavy hydrocarbon feed and catalyst mixture rises as a generally dilute phase through riser 4. There is little or no benzene in the alkylate, and catalytic cracking conditions are usually sufficient to dealkylate the alkylate to some extent, but not completely strip all alkyl chains in the riser. A considerable amount of alkylation also occurs in the riser. The net effect of adding alkylate to the riser is similar to that of adding more feed to the riser. Some slight production of benzene may occur, but only to a minor extent because the feed added contains so many alkyl groups that complete alkylation is unlikely. Cracked products and coked catalyst are discharged from the riser. Cracked products pass through two stages of cyclone separation shown generally as 9 in FIG. 1.

The riser 4 top temperature usually ranges from about 480 to 615 C. (900 and 1150 F.), and preferably between about 538 and 595 C. (1000 and 1050 F.). The riser top temperature is usually controlled by adjusting the catalyst to oil ratio in riser 4 or by varying feed preheat.

Cracked products are removed from the FCC reactor via transfer line 11 and charged to the base of the main column 10. The main column 10 recovers various product fractions, from a heavy material such as main column bottoms, withdrawn via line 35, to normally gaseous materials, such as the vapor stream removed overhead via line 31 from the top of the column. Intermediate fractions include a heavy cycle oil fraction in line 34, a light cycle oil in line 33, and one or more gasoline boiling range fractions in line 32. Much of the alkylate will be removed as a gasoline boiling range material in line 32. It is possible to provide multiple naphtha withdrawal points, e.g., a light naphtha and a heavy naphtha, or a single naphtha fraction may be sent to a splitter column to produce one or more naphtha boiling range fractions. These product recovery and fractionation steps are all conventional.

In the reactor vessel, cyclones 9 separate most of the catalyst from the cracked products and discharge this catalyst down via diplegs to a stripping zone 13 located in a lower portion of the FCC reactor. Stripping steam is added via line 41 to recover adsorbed and/or entrained hydrocarbons from catalyst. Stripped catalyst is removed via line 7 and charged to a high efficiency regenerator not shown. Catalyst regeneration is conventional.

The platinum reformer (PTR) 100 and alkylation reactor 120 will now be reviewed. A naphtha, usually a hydrotreated naphtha, is added via line 90 to PTR 100, shown simply as a black box. The reformate is removed via line 105, and charged to fractionator 110. A C5 minus stream is removed via line 112 from the top of the fractionator, and a C7 and heavier stream removed from the base of the fractionator. A C6 rich stream is removed via line 115 and charged to alkylation reactor 120.

An olefin rich stream, preferably light olefins generated in the cat cracker and recovered from the FCC main column in line 131, is added to the alkylation reactor 120. The C6 rich stream is overalkylated so that at least 90, and preferably well over 95% of the benzene in the reformate is converted in the alkylation reactor to alkyl benzenes, which are removed via line 125. The alkyl benzenes are fractionated in fractionator 140 to produce a light and/or heavy gasoline fraction removed via line 132 for addition to the refinery gasoline blending pool and a heavy alkylate stream which is removed via line 145. The heavy alkylate is charged to the FCC riser reactor 4, where it is converted to FCC naphtha, and perhaps some cycle oil, and olefinic gases. While some heavy alkylate will be converted to coke in the cracking reactor, it will usually be less than 5 wt % of the heavy stream, i.e., heavy alkylate is a relatively clean, low coke forming stock compared to most FCC feeds.

Although the present invention can use either moving bed or fluid bed cracking units, the discussion that follows is directed to FCC units which are considered the state of the art.

FCC FEED

Any conventional FCC feed can be used. The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The feeds usually will have an initial boiling point above about 650 F.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt % of the catalyst, with the rest being matrix. Conventional zeolites such as X or Y zeolites, or aluminum deficient forms of these zeolites such as dealuminized Y (DEAL Y), ultrastable Y (USY) and ultrahydrophobic Y (UHP Y) zeolites may be used. Zeolites may be stabilized with Rare Earths, e.g., 0.1 to 10 wt % RE.

The catalyst inventory may also contain one or more additives, either present as separate additive particles, or mixed in with each particle of the cracking catalyst. Additives can be added to enhance octane (medium pore size zeolites, sometimes referred to as shape selective zeolites, i.e., those having a Constraint Index of 1-12, and typified by ZSM-5, and other materials having a similar crystal structure).

The FCC catalyst composition, per se, forms no part of the present invention.

FCC REACTOR CONDITIONS

As far as the conventional heavy feed is concerned, conventional riser cracking conditions may be used. Typical riser cracking reaction conditions include catalyst/oil ratios of 0.5:1 to 15:1 and preferably 3:1 to 8:1. Expressed as catalyst to conventional heavy feed, e.g., VGO, these numbers will be slightly different, e.g., it is preferred that the catalyst to heavy hydrocarbon feed ratio (exclusive of reformate, and light or heavy additives) is at least 4:1, and preferably is about 4:1 to 10:1. The conventional catalyst-heavy oil contact time will usually be 0.1-50 seconds, and preferably 0.5 to 5 seconds, and most preferably about 0.75 to 4 seconds, and riser top temperatures of 900 to about 1050 F.

The conventional FCC reactor tolerates very well the presence of large amounts of heavy alkylate. In most instances, the conventional cracking operation will remain essentially unchanged, except for a slight increase in gasoline boiling range material due to the addition of heavy alkylate.

It is important to have good mixing of feed with catalyst in the base of the riser reactor, using conventional techniques such as adding large amounts of atomizing steam, use of multiple nozzles, use of atomizing nozzles and similar technology.

It is preferred, but not essential, to have a riser catalyst acceleration zone in the base of the riser. In the FIG. 2 embodiment, the heavy alkylate serves several functions, acceleration of the catalyst, generation of reactive fragments which react beneficially with the heavy feed, and reduction in benzene content of the reformate.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al, which is incorporated by reference.

It is preferred but not essential, to rapidly strip the catalyst just as it exits the riser, and upstream of the conventional catalyst stripper. Stripper cyclones disclosed in U.S. Pat. No. 4,173,527, Schatz and Heffley, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in U.S. Pat. No. 3,821,103, Owen et al, which is incorporated herein by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, which is incorporated by reference.

The FCC reactor and stripper conditions, per se, can be conventional.

CATALYST REGENERATION

The process and apparatus of the present invention can use conventional FCC regenerators.

Preferably a high efficiency regenerator is used. The essential elements of a high efficiency regenerator include a coke combustor, a dilute phase transport riser and a second dense bed. Preferably, a riser mixer is used. These regenerators are widely known and used.

The process and apparatus can also use conventional, single dense bed regenerators, or other designs, such as multistage regenerators, etc. The regenerator, per se, forms no part of the present invention.

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

REFORMER

Any conventional reformer feed usually a virgin naphtha boiling in the 200 to 400 F. range, preferably hydrotreated, can be used as the feed to any conventional reforming unit such as a fixed bed, swing bed, or moving bed reformer.

The process can also simply use the reformate product from one or more conventional reformers. It is not important to have a catalytic reformer in the refinery, reformate can be imported by tank car, pipeline, or similar means.

REFORMATE FRACTIONATION

The most uplift in value will occur when a relatively light and narrow boiling range reformate, such as a C6 or C6 and lighter fraction, is a majority of the reformate charged to the catalytic alkylation reactor. By C6 fraction we mean the complex mixture of hydrocarbons recovered overhead by a dehexanizer column operating downstream of a depentanizer. The composition of such a product stream varies greatly from refinery to refinery, and can vary greatly depending on severity of operation in the reformer, changes in reformer feed, etc. The cut points, or splitting of such streams to remove C4 fractions, as in a debutanizer, C5 fractions in a depentanizer, or C6 fractions in a dehexanizer is a common refinery practice. The split or separation achieved is far from perfect, but in most refineries the spectrum of products produced by a dehexanizer will contain at least 80 wt % C6 hydrocarbons, and preferably at least 90 wt % C6 hydrocarbons.

Relatively low octane light reformate fractions, such as a C5/C6 stream, or a C6 stream, are readily fractionated from reformate, and especially susceptible to upgrading by the process of the present invention. A benzene and lighter reformate having a research clear octane number of 80 to 85, and preferably of 81 to 84, is readily upgraded in octane while the benzene content thereof is significantly reduced.

Although most refiners refer to such light hydrocarbon streams by carbon number, e.g., C6 or C5/C6, roughly equivalent streams can be defined by boiling range. Expressed in this way, the preferred feeds to the alkylation unit will comprise normally liquid materials having an end point of at most about 250 F., and preferably no higher than about 230 F. Very good results will be achieved when the light reformate feed boils within the range of 100–212 F., and preferably within the range of 150–200 F., and most preferably within the range of 160–200 F. Expressed in metric units, the charge should contain all of the 80 C. boiling material and, given the limits of most commercial fractionators, it will be necessary to include material boiling at least about 5 C. above and below this temperature, and in many units it will be beneficial to have a 60–90 C. material, or even a 50–100 C. boiling range feed.

ALKYLATION CATALYST

Any catalyst which promotes reactions between benzene and light olefins can be used herein. The catalyst usually will be an acid acting catalyst, and can be either a solid or liquid. Solids are preferred, especially zeolite catalysts or other catalysts which promote alkylation despite the presence of contaminants and diluents so that low purity olefin streams may be used as the alkylating agent.

Suitable liquid catalysts include HF, H2SO4, or similar materials. Phosphoric acid on a support can be used.

AlCl3 and similar alkylation/transalkylation catalysts can be used.

Solid catalysts can be 100% amorphous, but preferably include some zeolite in a porous refractory matrix such as silica-alumina, clay, or the like.

Preferably a relatively high activity acid catalyst such as USY, REY, zeolite X, zeolite beta, and other materials having similar crystal structure and activity.

Especially preferred catalysts are shape selective zeolites, i.e., those having a Constraint Index of 1–12, and typified by ZSM-5, and other materials having a similar crystal structure). Another highly preferred catalyst comprises MCM-22. The synthesis of MCM-22 is disclosed in U.S. Pat. No. 4,954,325, which is incorporated herein by reference.

Although any acid acting catalyst can probably be made to work, some general guidelines on catalyst selectivity follow. The catalyst should have sufficient acid activity and selectivity to promote the desired alkylation reactions at reasonable temperatures and catalyst space velocities.

ALKYLATION UNIT OPERATING CONDITIONS

The catalyst and reaction conditions should be active, and severe enough, so that at least 90% of the benzene, and preferably at least 98%, and most preferably at least 99% of the benzene in the feed to the alkylation unit is alkylated. Ideally over 99.5% of the benzene is alkylated.

With most solid catalysts, the following reaction conditions can be used. Temperatures may range from 500 to 1200 F., preferably 600 to 1000 F., and most preferably from about 650 to 950 F. Although fluidized, fixed, or moving bed reactors can be used, the relative ratios of feed to catalyst, as applied to fixed beds will be provided. Weight hourly space velocities of 0.1 to 500 preferably 0.2 to 100 and most preferably 0.5 to 50 will usually give good results. Pressure may range from atmospheric, or even subatmospheric, to relatively high pressures, and usually will be from 1 to 1000 psig. Relatively low oil partial pressures, from 5 to 50 psia, are preferred. Hydrogen is not essential, but may be beneficial, particularly in extending catalyst life. When hydrogen is added, it may be present from 0.1:1 to 10:1, expressed as hydrogen to hydrocarbon mole ratios.

Preferably a catalyst of sufficient activity is used so that relatively low pressure operation, at low temperature, with an impure light olefin stream is possible. This permits low cost olefin rich streams such as those obtained from the FCC main column, or from the refinery gas plant, to be used as a source of reactive olefins for the alkylation reactor.

While the process of the present invention does not require a highly purified form of benzene feed, it can easily handle purified benzene streams, such as those produced by aromatics extraction units and efficiently convert them to high octane, benzene free gasoline. In some refineries, there may be no demand for the benzene product from an aromatics extraction unit, or the refiner may be forced to extract benzene from a light product stream to comply with a product specification. In these instances, the present invention provides an efficient way to dispose of these unwanted, though purified, benzene streams, and at the same time increase the production of high octane gasoline with a low benzene content.

ALKYLATION PRODUCT FRACTIONATION

High product purity is not important. A rough cut fractionation between gasoline boiling range alkylate and heavier materials downstream of the alkylation reactor will be sufficient. The economics of the process are not greatly altered if some gasoline boiling range alkylate is charged to the cat cracker. This relaxed fractionation demand reduces the capital and operating expense of the alkylation fractionator.

It is also possible to operate without the fractionator, or to operate the fractionator so that only the C6 and lighter hydrocarbons are removed from the alkylate. The C6 and lighter material may be recycled to the alkylation reactor in whole or in part, with the C7 and heavier material charged to the FCC unit. It is not especially beneficial to have, e.g., the TX portions of the alkylate recycled to the FCC reactor, but these streams will be so small in comparison to the size of the C9, and the C10 and heavier aromatics, that little loss will be observed by charging these back to the FCC.

ALKYLATE:FCC FEED RATIO

The amount of heavy alkylate added, relative to the conventional heavy feed to the cat cracking unit, can vary greatly, depending on the amount of benzene removal required and on the spare capacity of the FCC reactor and downstream processing equipment to process the extra material. The heavy alkylate will usually range from a low of 1 or 2 wt % of the total conventional feed, exclusive of recycle streams, to the FCC unit up to perhaps 5 or 10 % of the FCC feed. If benzene rich C6 reformate fractions become a distress product at other refineries, they may be profitably alkylated and upgraded in our FCC unit. Fairly large amounts of heavy alkylate may be charged to the FCC, as an example, from 10 to 50 wt % of the conventional heavy feed to the FCC unit, may be heavy alkylate.

The light reformate alkylate (LRA) product of the present invention should also reduce the equilibrium amount of benzene produced in the riser reactor. This is because the multiple alkyl chains which are readily dealkylated provide an ideal medium for alkylation and transalkylation of benzene in the FCC riser. This effect is not unique to LRA, i.e., others have suggested reacting durene with benzene at FCC riser cracking conditions to reduce the equilibrium benzene content. Durene addition is risky in requiring a reliable source of durene (a rare commodity in most refineries) and essentially complete elimination of durene from the product. Durene has a high melting point, but boils in the gasoline boiling range and can not be tolerated in the gasoline product. Use of LRA, instead of durene, preserves the ability to alkylate benzene almost to extinction, without introducing the risks associated with having durene in streams which may end up in the refineries gasoline pool.

EXAMPLE 1 (Prior Art)

This example shows the size of the problem in a typical commercial refinery, with a reformer and FCC, operating to produce almost 70,000 BPD of gasoline. Of the reformate produced, the C6 fraction contains 2330 BPD benzene.

The FCC normally contains about 330 BPD benzene.

The reformate and total gasoline pool data are:

| | BENZENE (BPD) | TOTAL (BPD) |
|---|---|---|
| Light Reformate | 2330 | 7000 |
| Gasoline Pool | 2660 | 68140 |

These data show that most of the benzene in the refinery gasoline pool, but by no means all of it, comes from the reformer. In most cracking/reforming refineries the reformer will contribute over 75% of the benzene in the pool, with considerable variation based on the relative sizes of the FCC and reformer. The cracking unit will usually contribute most of the gasoline, but usually less than ¼th of the benzene.

EXAMPLE 2 (Prior Art)

The following example is abstracted from U.S. Pat. No. 5,082,983, Breckenridge et al, which was incorporated by reference. Direct conversion of benzene with FCC catalyst was tested in a fixed fluid bed reactor at conditions simulating those in commercial riser reactors.

Operation with 10% benzene in FCC naphtha, at a Cat:oil ratio of 15, 1000 F., achieved 30% benzene conversion.

Operation with 10% benzene in FCC LCO, light cycle oil, at a Cat:oil ratio of 16, 950 F., achieved 29% benzene conversion.

These data show a surprising and effective amount of benzene conversion, but unfortunately most of the benzene is not converted.

This patent also included predicted equilibrium distributions from 50/50 molar mixtures of durene and benzene at conditions which would occur in a typical FCC riser reactor

| | FEED | EQUILIBRIUM |
|---|---|---|
| Benzene | 50 | 6 |
| Durene | 50 | 2 |
| Toluene | 0 | 26 |
| Xylenes | 0 | 39 |
| Trimethyl Benzene | 0 | 22 |
| Other Tetram. Bz | 0 | 5 |

EXAMPLE 3

This example represents an actual experiment on alkylation of light reformate.

The feed was a light reformate. The alkylating agent was a simulated fuel gas. The alkylation catalyst was MCM-22. The alkylation reaction conditions were once through, at a severity sufficient to achieve over 90% conversion of benzene.

A summary of aromatic feed and product components follows:

TABLE 2

| Experimentally Observed LRA Yields | | |
|---|---|---|
| Component | C5+ Feed (Moles) | C5+ Product (Moles) |
| Benzene | 1.91 | 0.10 |
| Toluene | 0.45 | 0.01 |
| C8 | 0.00 | 0.00 |
| C9 | 0.00 | 0.54 |
| C10 | 0.00 | 0.12 |
| C11 | 0.00 | 0.02 |
| C12 | 0.00 | 0.73 |
| C13 | 0.00 | 0.25 |
| C14 | 0.00 | 0.39 |
| C15 | 0.00 | 0.11 |
| C16 | 0.00 | 0.04 |

EQUILIBRIUM ESTIMATE

The composition of the following streams at FCC conditions was estimated. This approach, an equilibrium estimate, is similar to that used in U.S. Pat. No. 5,082,983, but differs in that LRA rather than durene is added.

| | FCC Product | FCC + LRA FEED | EQUILIBRIUM ESTIMATE |
|---|---|---|---|
| Benzene | 3.8 | 4.1 | 0.1 |
| Toluene | 17.5 | 9.0 | 1.7 |
| Xylenes | 31.5 | 15.8 | 10.5 |
| C9 | 10.9 | 8.1 | 34.3 |
| C10 | 6.8 | 3.8 | 29.8 |
| C11+ | 29.5 | 59.2 | 23.6 |

This equilibrium estimate shows the great potential for benzene reduction in an FCC riser using light reformate alkylate (LRA). Although the C10− concentration increases, there are significant reductions in BTX. Well over 95% of the benzene is removed. Roughly 90% of the toluene is removed, and almost ⅔'s of the xylenes are removed. The removal efficiency matches the toxicity characteristics, e.g., the most toxic by far are the gasoline boiling range (benzene) is almost eliminated, while roughly 90% of the toluene is converted. A significant reduction in xylene content is achieved, but almost ⅓ remain, which can be tolerated as these have much lower vapor pressure than the lighter aromatics, and are also less toxic.

DISCUSSION

Our unusual processing sequence, an impure starting material and over alkylation, followed by catalytic cracking of at least the heaviest portions of the alkylate, provides the key to an efficient, low cost, and low gasoline loss route to low benzene motor fuel. We can directly reduce the benzene content of the reformate, and less directly reduce the benzene content of the FCC naphtha. We do this with little loss from the gasoline pool, and even improve the pool octane some.

These unusual operating conditions and simplified product fractionation (it can be eliminated) give refiners a way, for the first time, to economically produce gasoline with extraordinarily low benzene content, with only modest capital expense required.

We claim:

1. A process for producing a gasoline product with a reduced benzene content comprising:

a) producing a benzene rich gasoline product fraction by reforming a naphtha boiling range feed comprising normally liquid hydrocarbons boiling below about 400° F. in a reforming reactor containing a platinum based reforming catalyst at catalytic reforming conditions to produce a reformate consisting of gasoline boiling range hydrocarbons and lighter hydrocarbons;

b) fractionating said reformate to produce a C6 fraction containing benzene;

c) alkylating said C6 reformate fraction by charging said C6 fraction to an aromatics alkylation zone and alkylating with an alkylating agent comprising at least one of C2, C3 and C4 olefins which are added to said alkylation zone, operating at aromatics alkylation conditions sufficient to alkylate over 90% of the benzene and produce heavy alkylate, a polyalkylated benzene product boiling above about 400° F. and too high for use as a gasoline fuel, which is removed from said alkylation zone and mixing said heavy alkylate with a conventional fluidized catalytic cracking feed comprising normally liquid hydrocarbons boiling above about 650° F. to form a feed mixture;

d) catalytically cracking, in the absence of added hydrogen, said feed mixture in a catalytic cracking reactor operating at catalytic cracking conditions to produce a spectrum of catalytically cracked products from said conventional feed and crack a majority of the heavy alkylate product boiling above 400° F. to alkylated benzene species boiling below 400° F. and in the gasoline boiling range and removing from said cracking reactor a vapor stream containing cracked products included cracked heavy alkylate;

e) fractionating said vapor stream in a fluidized catalytic cracking cracked product fractionator operating at fractionation conditions to produce a catalytically cracked naphtha fraction comprising normally liquid hydrocarbons boiling below about 400° F. including at least a majority of the polyalkylated benzene added to the cracking reactor.

2. The process of claim 1 wherein the heavy alkylate fraction is added in an amount equal to 1 to 50 wt % of said conventional fluidized catalytic cracking feed.

3. The process of claim 1 wherein the heavy alkylate fraction is added in an amount equal to 1.5 to 7.5 wt % of said conventional fluidized catalytic cracking feed.

4. The process of claim 1 wherein the reformate is fractionated to produce a C6 fraction charged to the alkylation reaction zone containing at least 90 wt % 150 to 200 F. hydrocarbon.

5. The process of claim 1 wherein the benzene is alkylated with C2 and C3 olefins recovered from the cracking reactor.

6. The process of claim 1 wherein the alkylation reaction conditions include a mole ratio of benzene to added olefin from 3:1 to 100:1.

7. The process of claim 1 wherein the alkylation reaction is operated at conditions sufficient to convert at least 50% of the benzene to alkylated benzene species having at least 12 carbon atoms.

8. The process of claim 1 wherein essentially all of the normally liquid alkylation reaction zone effluent is charged to said cracking reactor.

9. The process of claim 1 wherein the alkylation reaction zone effluent is fractionated to produce a gasoline boiling range alkylate which is recovered as a product for use in the refinery gasoline pool and a heavy alkylate fraction boiling above about 400 F. which is charged to said cracking reactor.

10. The process of claim 1 wherein the alkylation catalyst is MCM-22, and the benzene containing light reformate is alkylated on a once through basis with an olefin containing fuel gas derived primarily from the fluidized catalytic cracking unit, and wherein alkylation conditions are sufficient to alkylate over 90% of said benzene.

11. A fluidized catalytic cracking process for the production of a gasoline boiling range product containing less than 1.0 wt % benzene from a heavy hydrocarbon fluidized catalytic cracking feed containing hydrocarbons boiling above about 650° F. comprising:

a. adding to said heavy fluidized catalytic cracking feed 1 to 50 wt % of a light reformate alkylate produced by alkylating a C6 reformate fraction in an alkylation reactor with sufficient C2, C3 and/or C4 olefins added to said alkylation reactor to produce an alkyl aromatic product having 12 or more carbon atoms and essentially free of durene to form a feed mixture;

b. catalytically cracking said feed mixture in a catalytic cracking zone operating at catalytic cracking conditions by contacting said feed with a source of hot regenerated cracking catalyst to convert at least 60 wt % of the fluidized catalytic cracking feed to lighter products and produce a cracking zone effluent mixture comprising cracked products and spent cracking catalyst containing coke and strippable hydrocarbons;

b. separating said cracking zone effluent mixture into a cracked product vapor phase and a spent catalyst rich phase;

c. stripping and regenerating spent catalyst to produce regenerated catalyst which is recycled to said cracking reactor; and d. transferring from said cracking reactor said cracked product vapor via a transfer line to a main fractionator which recovers liquid product fractions including a gasoline boiling range fraction having less than 1.0 wt % benzene.

12. The process of claim 11 wherein the alkylate:conventional fluidized catalytic cracking feed weight ratio is from 1.5:100 to 7.5:100.

13. The process of claim 11 wherein the cracking reactor is a riser fluidized catalytic cracking reactor.

14. The process of claim 11 wherein the alkylating agent is C2 and C3 olefins generated by the cracking reactor.

15. The process of claim 11 wherein at least 50 wt % of the alkylate has 13 carbon atoms or more, and is present in said fluidized catalytic cracking reaction zone in an amount sufficient to generate alkyl fragments which react with benzene present and/or formed in said catalytic cracking reactor to reduce the benzene content of the gasoline product to less than ½ of the benzene content of a gasoline product produced from a fluidized catalytic cracking reactor operating without alkylate addition, and less than 0.5 wt % benzene.

* * * * *